United States Patent [19]

Martiny

[11] Patent Number: 4,785,696

[45] Date of Patent: Nov. 22, 1988

[54] HIGH-SPEED APPARATUS FOR FORMING SHEETS FROM A WEB

[75] Inventor: Michael L. Martiny, Evanston, Ill.

[73] Assignee: Kraft, Inc., Glenview, Ill.

[21] Appl. No.: 34,270

[22] Filed: Apr. 3, 1987

[51] Int. Cl.[4] ..... B26D 1/62; B26D 9/00; B26D 3/00

[52] U.S. Cl. ..... 83/152; 83/49; 83/37; 83/303; 83/345; 83/346; 225/94; 225/95; 493/343; 493/346; 493/362

[58] Field of Search ..... 83/49, 300, 303, 345, 83/346, 152; 493/346, 361, 362, 365, 343; 225/94, 95

[56] References Cited

U.S. PATENT DOCUMENTS

| | | | |
|---|---|---|---|
| 1,067,626 | 7/1913 | Smith | 493/362 |
| 2,276,282 | 3/1942 | Bindszus | 93/3 |
| 2,334,381 | 11/1943 | Bronander | 493/346 |
| 2,346,044 | 4/1944 | Nadeau | 93/3 |
| 3,168,016 | 2/1965 | Kehr | 98/8 |
| 3,452,650 | 7/1969 | Cobb | 493/361 |
| 3,618,286 | 11/1971 | Membrino | 53/384 |
| 3,630,122 | 12/1971 | Chambon | 83/49 |
| 3,658,220 | 4/1972 | Norton | 225/94 |
| 4,041,816 | 8/1977 | Shearon | 83/100 |
| 4,151,699 | 5/1979 | Focke et al. | 53/228 |
| 4,430,844 | 2/1984 | James | 53/450 |

*Primary Examiner*—Frederick R. Schmidt
*Assistant Examiner*—William E. Terrell
*Attorney, Agent, or Firm*—Fitch, Even, Tabin & Flannery

[57] ABSTRACT

A method and apparatus for presenting a serial succession of cut sheet portions to a work station. The sheet portions are cut from a continuous webbing which is processed by a cutting station and a web-breaking station. The cutting station partially severs the web downstream of its leading free end so as to define a first sheet portion between that free end and the point of cutting, with the first sheet portion connected to the web by one or more tab connectors. The webbing is then advanced downstream to the tab-breaking station where the tabs are broken to free the first sheet portion for independent movement further downstream. A vacuum belt engages the webbing, and particularly the downstream edge adjacent the partial severing, with a vacuum belt. The vacuum belt engages the webbing by bridging the partially-severed cut portion, so as not to interfere with the downstream tab-breaking apparatus. A continuous control over the cut sheet portions is provided prior to the breaking of the tab portion, and continues to the final delivery of the cut sheets.

3 Claims, 2 Drawing Sheets

44
42
42
44
7
6
34
32
38
56
40
46
58
66
76
76
76
78
78
70
70
72
12
70
64

50
12b
48
50
52
48
12a
12

44
42
38
44
42
12
40

38
12
46
40

70
76
12
84
78
72

HIGH-SPEED APPARATUS FOR FORMING SHEETS FROM A WEB

BACKGROUND OF THE INVENTION

1. Field of the Invention

The present invention pertains to methods and apparatus for processing a web of sheet material, such as a paper web, for example, and in particular pertains to methods and apparatus for presenting cut sections of a web to a work station. Such methods and apparatus are particularly suitable for presenting a continuous succession of cut web sections such as margarine or cream cheese wrappers to a work station such as a wrapping station in a packaging operation.

2. Brief Description of the Prior Art

The commercial production of consumer-sized food product such as margarine sticks and cream cheese bricks involves a final wrapping and packaging of the items in a continuous fully automated process. The automated wrapping of product items in paper, foil or the like materials oftentimes uses material from webs or rolls stored at the packaging site. Typically, in fully automated processes, the web is paid out as the web material is distributed along one or more processing stations where it is imprinted, scored or formed immediately prior to wrapping of the product item. Of course, material taken from the web must be cut or otherwise separated into conveniently sized sheets.

In an automated packaging facility, it is commonly desirable to provide a continuous succession of wrapped items, ready for packaging in a shipping container or the like. While a plurality of items can be wrapped beforehand and stored for final packaging, the space needed for such batch-processing frequently can be put to more productive use. Also, certain economies of operation are realized if an automated assembly line can be operated in a continuous mode, without requiring repeated startup and shutdown.

Accordingly, it is desirable to mate a continuous stream of wrappers to a continuous stream of product items in a smooth-flowing wrapping operation. Improvements in assembly lines for wrapping product items frequently focus on lower numbers of rejects, and higher production rates. Essential to both goals is the accurate and precise positioning of a continuing succession of wrappers with respect to a continuous succession of product components, both of which are handled by automated machinery, which, for reasons of economy, are not capable of adjusting their range of motion to accommodate mispositioned components or wrappers.

One problem that has beset high-speed wrapping operations for some time is the loss of control over the position of individual wrappers as they progress along the various work stations of the wrapping assembly line. Web materials such as paper, foil or the like are susceptible to bending, curling or changes in shape or form due to humidity and different winding tensions. Further, and quite importantly, materials of these types are susceptible to aerodynamic instability, as when the sheets are conveyed in directions parallel to their major surfaces. Aerodynamic instability, aggravated by the semi-permanent deformations encountered when these materials are wrapped around a roll, exhibit a tendency to "lift" or become laterally deflected at their leading edge, creating a sail-like surface against which forces of air motion create an unstable condition in which the deflection of the leading edge is perpetuated and/or augmented. The disturbing forces of air motion are, of course, increased as the production rate is increased, since the velocity of the cut sheets between various work stations of the assembly line is raised in a corresponding fashion.

Other problems are encountered in the high-speed formation of cut sheets from material which is adhesive, adhering to the cutting blades which process the material web. An example of such material is waxed paper, the waxed coating of which tends to build up on cutting blades during a production run. This process may be accelerated as friction associated with a high speed cutting operation softens or partially melts the wax coating. Such wax coatings are frequently encountered in the food industry, especially with products that are oily or would penetrate uncoated paper material. For example, margarine sticks and the like are frequently wrapped in waxed paper, and the wrapped product items are packaged in wax-coated paperboard to prevent the oily product material from penetrating the wrapping and packaging materials.

Accordingly, an object of this invention is to provide methods and apparatus for the production of a continuous succession of cut sheets, by processing a continuous web of sheet material from which the sheets are formed.

Another object is to provide a novel method and apparatus for the high-speed production of cut sheets from a web, in which the position of the webbing and sheets is carefully controlled throughout. These and other objects and advantages of this invention will be apparent from the following detailed description and the accompanying drawings.

DRAWINGS

Figure 4:
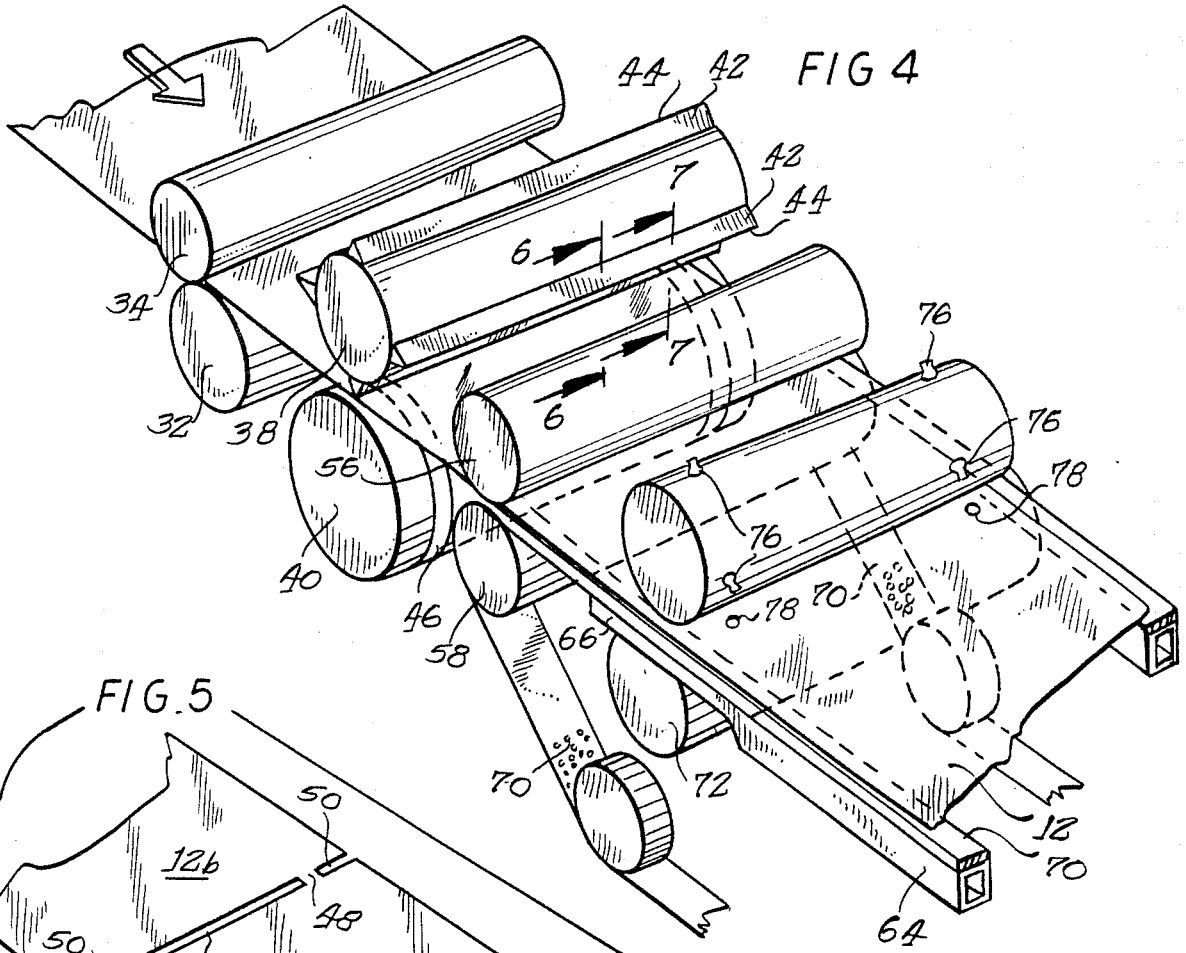
FIG. 4 is a partial, perspective view of a portion of the apparatus of FIG. 1, corresponding generally to the views illustrated in FIGS. 2 and 3.
Figure 6:
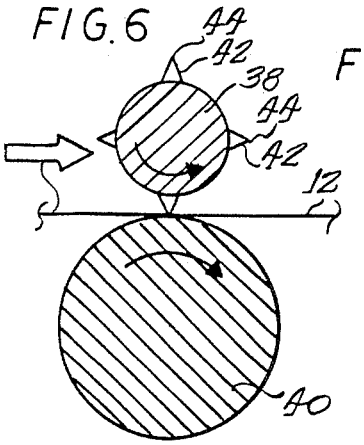
Figure 7:
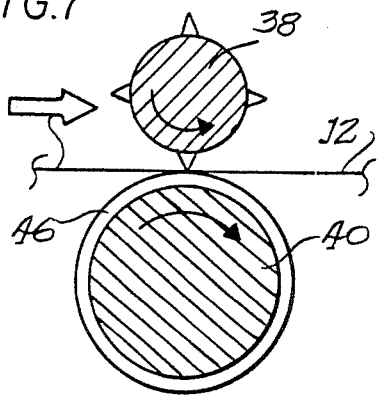
Figure 8:
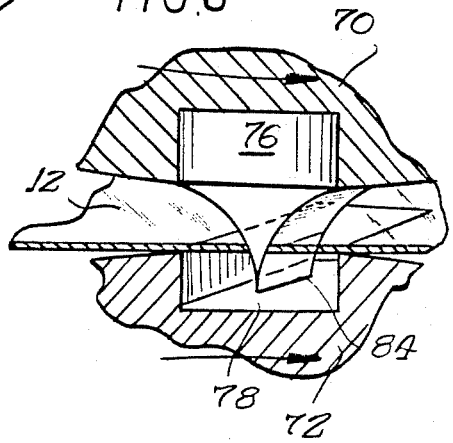

FIGS. 6 and 7 are cross-sectional elevational views taken along the lines 6—6 and 7—7 of FIG. 4; and FIG. 8 is a perspective view of a portion of the apparatus illustrated in FIGS. 1–4, located in a downstream portion of the apparatus.

SUMMARY OF THE INVENTION AND DESCRIPTION OF THE PREFERRED EMBODIMENT

In accordance with the present invention, methods and apparatus are provided for the production of a continuous succession of cut sheets. Such methods and apparatus are particularly adapted for high-speed production of sheets which are formed from a continuous roll of webbing. One example of a need for the method and apparatus of the invention is found in the high-speed continuous wrapping of product items such as food products of the margarine stick and cream cheese brick variety. Numerous other applications for the present invention will become apparent from the following.

In accordance with apparatus aspects of the present invention, a web defining a continuous serial succession of sheet portions with intermediate portions therebetween is processed to provide a continuous succession of cut sheets downstream of the web. One example of such a web is formed from a laminated composition of two web materials, such as a tin foil and paper. The apparatus includes a first work station and web-feeding means for feeding a first sheet portion downstream of the first work station so as to present an intermediate web portion thereto. The intermediate web portion, interposed between the first sheet portion and an adjacent, following sheet portion is partially severed at the first work station so as to define at least one tab which interconnects the first and the following sheet portion. The location of the tabs formed at the first, severing work station is carefully controlled to provide an accurate positioning of the tab, for reasons which will become apparent herein.

One example of the partial severing is the cutting of the web along a line, the cutting being discontinuous so as to form at least two relatively narrow tab portions connecting the sheet portions which are defined by the cutting operation. An example of a partial severing apparatus is given by a pair of opposed rollers through which the web is fed. One roller contains a plurality of cutting blades spaced about its outer surface and extending the length of the roller, so as to correspond generally to the width of the web. The edges of the cutting members contact the outer surface of the opposing roller which serves as an anvil, to impart a cutting action to a web passing between the rollers. Annular or ring-like recesses in the anvil roller prevent severing of the web and limit the action of the cutting blades to that of a partial severing of the web. Generally, the width of the annular recesses corresponds to the width of the tab means formed at the work stations.

The apparatus further includes a second station located downstream of the first, severing station. The second station includes apparatus for breaking the tabs formed at the first work station, and the alignment of the tab-breaking apparatus is carefully controlled to avoid contact with a web-transport means engaging the partially-severed web, and extending both upstream and downstream of the second work station. One example of a web transport means is a continuous belt apparatus in which two relatively narrow belts engage the web at one side of the tabs so as to bridge the sheet portions which are held together by the tabs. The web transport means maintains control of the position of the sheet portions after the tabs are broken at the second work station. One reason why control of the sheet portions is an important aspect of the invention, is that high-speed production rates require web transport speeds which render the sheet material aerodynamically unstable. In one example of tab-breaking means, the tabs are cut by a pair of opposed rollers through which the web is fed. One roller includes a projecting tooth-like protrusion, which is received in recesses in the opposing roller. When entering the recess, the projection stresses and breaks the tab held between the two rollers.

In accordance with method aspects of the present invention, the method includes the step of providing a roll of webbing having a free end and a preselected portion spaced from the free end. The method includes moving the free end of the webbing in a downstream direction so as to present the preselected portion of the webbing to a first work station having means for partially severing the webbing. The preselected portion of the webbing is partially severed at the first work station, so that the first sheet is partially defined between the preselected portion and the free end of the webbing, with at least one tab interconnecting the first sheet to the webbing.

The method further includes the step of transporting the partially-severed, preselected portion to a downstream, second work station. Breaking of the tab occurs at the second work station, freeing the first sheet for independent movement, relative to the webbing. The method further includes the step of engaging the webbing with web transport means, before the preselected portion is presented to the second work station, and thereafter, as the cut sheet is presented to a downstream location.

A more detailed description of the methods and apparatus of the present invention will now be given, with reference to the drawings, and especially to FIGS. 1–4 which illustrate an arrangement or apparatus 10 for preparing, feeding, and cutting wrapper material to provide a continuous succession of cut sheets. The wrapper material, from which the sheets are cut, preferably comprises a composite web 12 supplied either from roll 16, or roll 20. The composite web 12 preferably comprises a layer of tin foil glued to a layer of paper. The composite web may also take on other forms, such as a layer of waxed paper taken either alone or glued to a tin foil web. The ends of the composite webs are spliced together at conventional apparatus 22. The composite web 12 is thereafter fed through a shock-absorbing festoon apparatus 24 where it is introduced into a wrapper feed and cutoff assembly, designated generally at 28. At its initial entry point, assembly 28 includes idler rollers 30*a*, 30*b*, which precede the first, upstream feed rollers 32, 34, which in the illustrated drawing, pull the web material from rollers 16, 20 through the festoon apparatus. Preferably, web 12 is continuous and uninterrupted by preformed perforations, edge nicks, score lines and the like added-value constructions. Such could be employed in the present invention if the added cost to identify individual sheet portions, cut lines, edge margins and the like is not objectionable. Preferably, however, a serial succession of sheet portions are defined along the web, by the apparatus and method of operation, as will be explained below. For example, the preferred embodiment produces a continuous succession of cut sheets, each corresponding to the configuration of sheet portion 12*a* illustrated in the center of FIG. 5.

Figure 1:
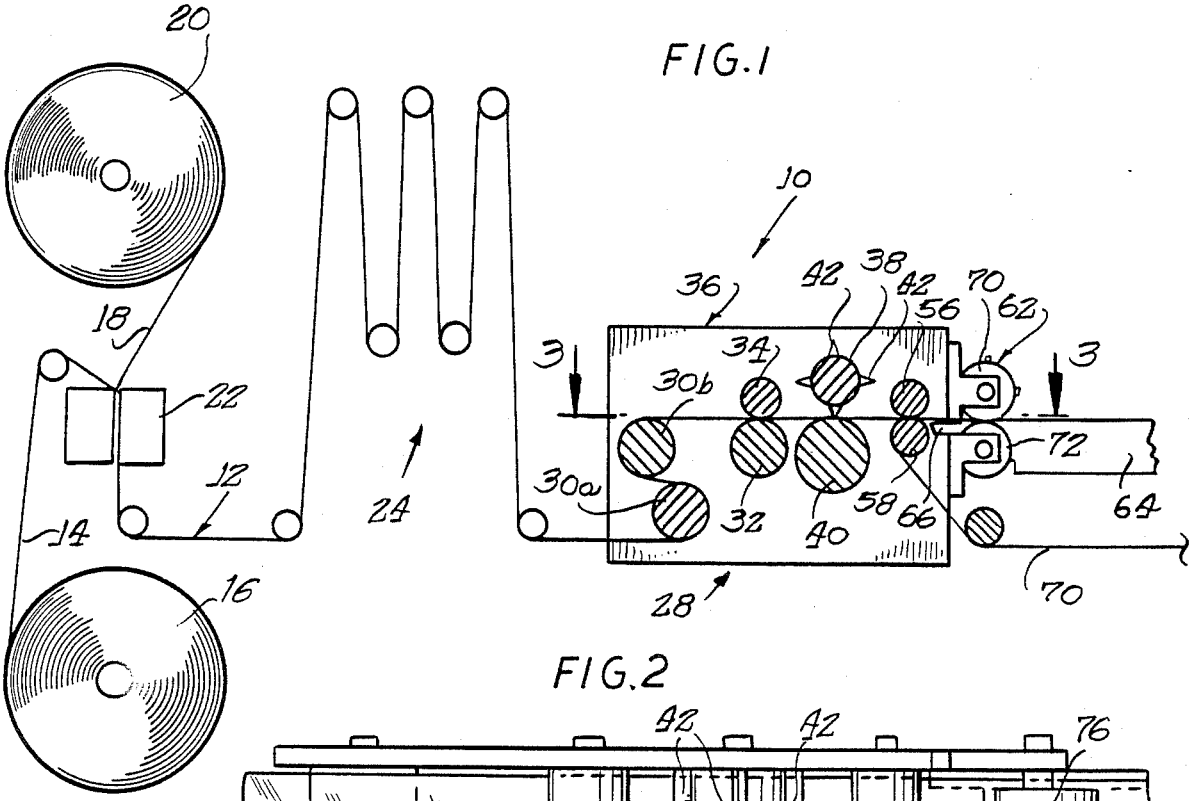
FIG. 1 is an illustration of apparatus for the production of a continuous succession of cut sheets in accordance with invention.
Figure 2:
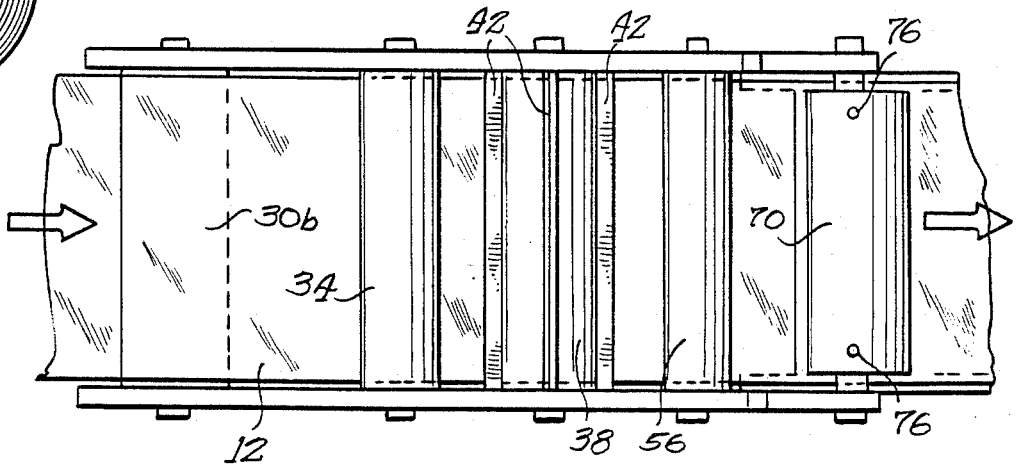
FIG. 2 is a top plan view of a portion of the apparatus of FIG. 1, indicated by the phantom line 2—2 of FIG. 1.
Figure 3:
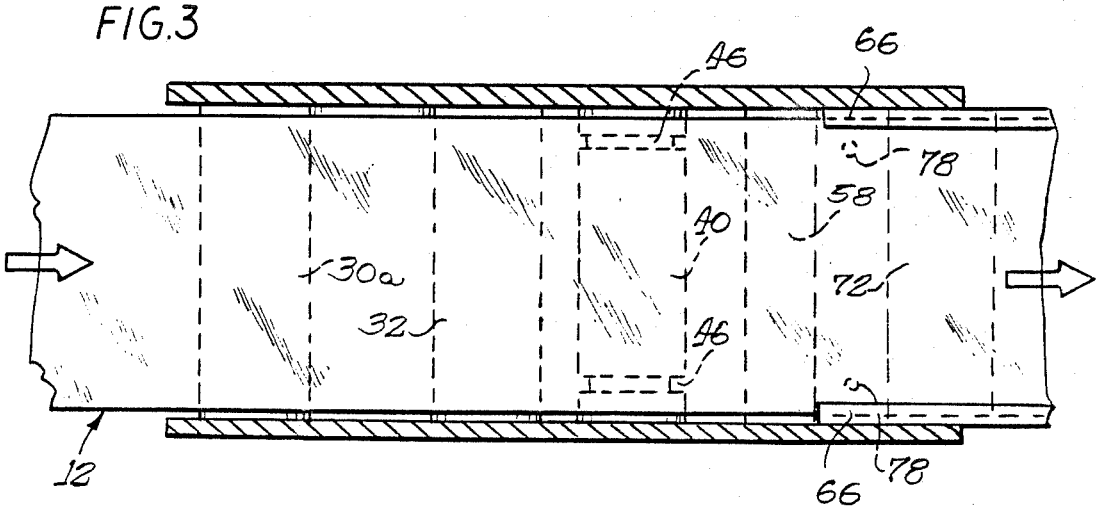
FIG. 3 is a partial, cross-sectional view of the apparatus of FIG. 1, taken in plan along the line 3—3 of FIG. 1.

The web 12 is brought into position in apparatus 28 so as to be aligned with a cutting station 36 thereof which comprises an upper cutting roller 38 and a lower anvil roller 40. As shown in FIGS. 1, 2 and 4, (and additionally in FIGS. 6 and 7 as will be described) cutting roller 38 includes a series of spaced cutting blades 42 having knife-like cutting edges 44. Anvil roller 40 is preferably formed of hardened steel, providing a firm surface against which knife blades 42 can act so as to sever web 12 in the desired manner. In particular, cutting station 36 is designed to only partially sever the web, and accordingly anvil roller 40 is provided with inwardly-extending annular depressions or undercuts 46 for forming the tab-like joining sections 48 illustrated in FIG. 5. FIGS. 6 and 7 show the knife blades 42 in cutting relationship to the outer surface of anvil roller 40 (FIG. 6)

and in relation to the undercut portion 46 (see FIG. 7). As illustrated in FIG. 6, web 12 is held in intimate engagement over the outer surface of anvil roller 40 and provides a backing surface against which knife blades 42 act to penetrate web 12 with a cutting action.

In contrast, the undercut portion shown in FIG. 7 allows web 12 to relax slightly, entering into the undercut recess 46 thereby effectively preventing knife blade 42 from penetrating that portion of the web generally defined by the lateral extent of the undercut. Consequently, two portions of web 12 corresponding in width to the width of undercut recesses 46 remain, and form the tab-like connecting portions 48 shown in FIG. 5. It can be seen that cutter blades 42 in the preferred embodiment form three partial severing cuts, the two outer cuts 50 and the centrally located inner cut 52, the cut 52 being separated from the cuts 50 by the tab-like connector portions 48. Although two tab-like connecting portions of significant width are illustrated in FIG. 5, any number of tabs of any particular dimensions relative to the size of the web could be employed, it being recognized that an important feature of the tabs is to hold adjacent sheet portions together as the web advances through the downstream wrapper feed and cutoff assembly, as will be explained.

Figure 5:
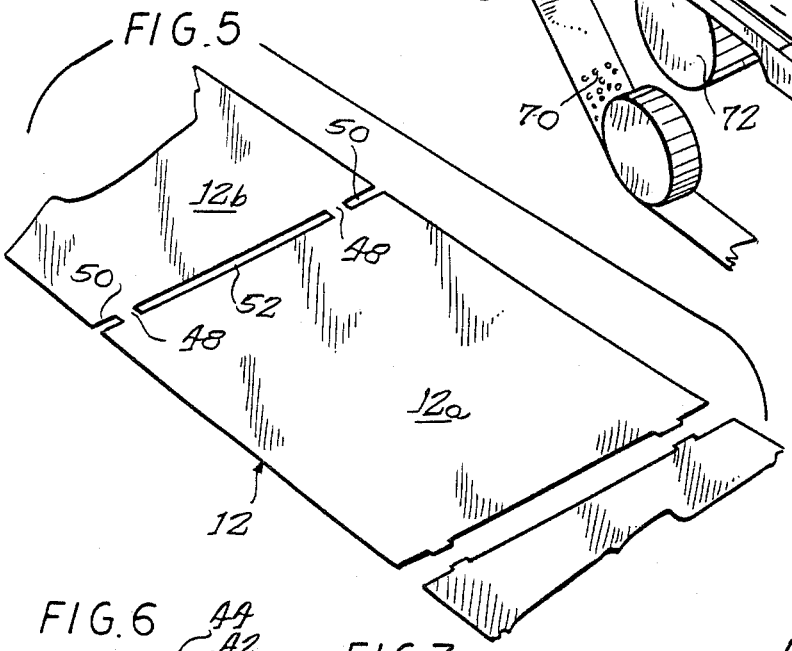
FIG. 5 is a perspective view of a web being processed by the apparatus of the preceding Figures.

In the preferred embodiment, knife blades 42 produce an intermediate or cut section between adjacent sheet portions which is extremely thin, the width of cut sections 51, 52 being greatly exaggerated in FIG. 5, for purposes of clarity. However, other cutting arrangements are possible, and are contemplated by the present invention.

For example, rather than being sharpened to a point, the cutting edges 44 of cutting blades 42 can be hollow ground to present a pair of spaced cutting edges, at the tip of each knife blade. This latter alternative arrangement would generally remove an intermediate portion generally having the width illustrated in FIG. 5. Alternatively, the intermediate or cut sections 50, 52 can be made considerably wider than those illustrated in FIG. 5 and, regardless of width, can also have a variety of shapes, not lying along a straight line. The severing line may, for example, comprise a zigzag pattern such as one created with pinking shears. Alternatively, the cut portion could be generally V-shaped, resembling an arrowhead pointing along the centerline of the web. In this latter arrangement, if multiple connector parts between adjacent sheets are provided, they need not be aligned laterally adjacent each other as in FIG. 5, but may be offset from each other in an axial direction. To accommodate this alignment, the set of punch members on upper roller 70 can be angularly displaced one from the other to coordinate with the position of connector portions passing thereunder, as web 12 is advanced along the wrapper feed and cutoff assembly.

The cut portion could also lie along a straight line, but one which is not perpendicular to the axis of the web. If multiple tab-like connector portions are provided, they would not be positioned laterally adjacent each other.

Turning again to a general description of apparatus 10, a second set of feed rollers 56, 58 is located downstream of cutting station 36. In the preferred embodiment, the feed rate of downstream rollers 56, 58 is closely matched to that of upstream feed rollers 32, 34 so as to reduce or eliminate tension in portions of web 12 located between the two sets of feed rollers. An important feature of the present invention is that the sheet portions lying on either side of cutting station 36 are only partially severed, having at least one connector part therebetween, so that downstream feed rollers 56, 58 can cooperate in providing a well-defined control over the sheet portions exiting the cutting station 36. As will be appreciated by those skilled in the art, control over the sheet portions, especially the leading edges thereof during travel through assembly 28, is particularly critical for higher feed rates of the webbing material. For example, in the preferred embodiment, webbing material 12 is fed through the wrapper feeding and cutoff assembly 28 at a speed of approximately 300 feet per minute. At this rate of speed, and even at rates of speed considerably lower, cut sheets completely severed from one another are subjected to strong aerodynamic forces at their forward, leading edges which levitate or otherwise displace the sheet. It is noted by way of background information that various methods and apparatus for funneling or otherwise guiding the newly-formed free end of a sheet between cutting station 36 and the next downstream station have been attempted, but without the success necessary for a commercially practical operation. In addition to the leading edge of the cut sheet being deflected away from such funneling or guiding apparatus, the leading edge was observed to fold over upon itself, thereby jamming succeeding lengths of webbing material in accordion-like fashion within the funneling or guiding apparatus.

Another problem solved by the present invention arises when web material having an adhesive quality is cut by the cutter blades 42, with the free end of the webbing adhering to the cutting blade and consequently being wrapped around the cutting roller 38. In addition to causing a paper jam and loss of cutting performance, the next cutting blade is prevented from completely severing the webbing passing thereunder. Particular examples of a web material exhibiting adhesive qualities include waxed paper and laminates of tin foil and paper glued together. These web materials are used extensively in the food industry to contain oily products or products otherwise exhibiting an ability to penetrate uncoated, relatively porous wrapping materials. These types of wrapping materials are also used with metal articles that are oiled to prevent their oxidation. Malfunctions in cutting machinery due to the adhesive quality of these web materials have been noted, particularly at higher production rates wherein the waxed coating or glue builds up on the cutting blades at a faster rate, with friction created in the high-speed cutting step softening or partially melting the wax coating or glue, thereby enhancing the accumulation of a cohesive buildup of wax or glue and paper dust on the cutting blades. With the present invention, even if the cutting blades 42 should acquire a build-up of wax, glue, or other potentially adhesive material, the strength of the connecting portion(s) 48 is great enough to resist such cohesive attachment to the cutting blade as it continues to travel along the path of the cutting roller.

Eventually, in order to produce a continuous succession of cut sheets, the connecting portions 48 must be broken. The present invention provides continued control over the newly-cut sheet as the sheet continues to progress through the wrapping and packaging assembly line even after the tab-like portions 48 are broken at the downstream breaker station 62, as will be described herein. At this point, and at points downstream of breaker station 62, a leading edge of a cut sheet is formed, which would otherwise be subjected to the strong aerodynamic forces referred to above but for the inter-sheet connector portions. In order to ensure continuous, added control over the cut sheet portions, a vacuum belt arrangement is introduced between the feed rollers 56, 58 and stations downstream thereof, such as the breaker station 62.

Referring to FIGS. 1–4, the vacuum belt arrangement includes a vacuum chamber 64 having a forward portion 66 located adjacent feeder rollers 56, 58. The vacuum chamber 64 includes an upper surface which is perforated to draw a continuous vacuum, i.e., flow of air therethrough. Overlaid on the upper surface of the vacuum chamber 64 is a perforated endless belt 70 which engages the underside of laterally outer edges of web 12. Preferably, vacuum belt 70 provides continuous control of the cut sheet portions throughout the remainder of their travel along the wrapping assembly line.

The lower feed roller 58 defines the path of vacuum belt 70, and the upper feed roller 56 is conveniently provided to cooperate with roller 58 in feeding the web 12. Owing to the below-described cooperation of rollers 70, 72 as feed rollers, the intermediate roller 56 can be eliminated if desired.

In particular, it should be noted that vacuum belt 70 extends both upstream and downstream of breaker station 62 which completes the severing of adjacent sheets. Breaker station 62 includes an upper breaker roller 70 and a lower, anvil roller 72, shown in enlarged detail in FIG. 8.

Web 12 is firmly controlled by vacuum belt 70 prior to breaking of the connecting parts 48, thereby ensuring continuous control of the sheet portions as they are broken, cut, or otherwise severed from the downstream web at station 62. In the preferred embodiment, the leading end of the sheet portion is controlled between two sets of feed rollers as it engages the forward end of the vacuum belt 70.

The upper breaker roller 70 includes two ring-like arrays of spaced, tooth-like punch members 76 which are received in undercut slot portions 78 formed as recesses in the outer surface of anvil roller 72A. The depth of penetration of punch member 76 into recess 78 is sufficient to punch, tear, or otherwise break the connecting portions 48. The remaining surface of the roller 70, not carrying the punch members, preferably acts as an auxiliary feed roller cooperating with the anvil roller 72 to provide further control of the cut sheet portions. It is preferred, however, that the vacuum belt 70, extending upstream of breaker station 62 be sufficient by itself to maintain the desired degree of positional control over severed web portions lying downstream of feed rollers 56, 58.

The cycle of operation continues after the tooth-like punch members 76 have completed a breaking of a previously-processed sheet portion. Breaker roller 70 continues its rotation, providing additional web feed in cooperation with anvil roller 72. Eventually, the partially severed joining section of a subsequent sheet portion is brought into position over the forward portion 66 of the vacuum belt arrangement. At this point, the sheet portion lying immediately downstream of the joining section is completely controlled prior to its alignment with the punch member 76.

In the preferred embodiment, punch members 76 have a generally blade-like appearance, being formed at the juncture of two concave surfaces 82, which terminate at a straight line cutting tip 84. Punch members 76 are preferably formed of nylon or other rigid plastic material, principally to prevent the risk of damage during set-up or operation should rollers 70, 72 fall out of sequence with each other. This is particularly troublesome since, unlike the cutting rollers 38, 40, punch members 76 extend past the outer surface of lower roller 72.

The present invention also contemplates other configurations of punch members 76, other than that illustrated in FIG. 8, as described above. For example, punch members 76 can have a sharp pointed tip or any other configuration which cuts, tears or otherwise breaks the tab-like connecting portions 48. Although cutting roller 38 and breaker roller 70 are illustrated as conveniently having four cutting blades and punch members, it is contemplated that the rollers could carry any number of one or more cutting or punching members. Also, although the cutting and breaker stations are illustrated as cooperating rotating members so as to conveniently provide additional web feed, the present invention also contemplates that they could have a reciprocating path of travel or some other nonrotating arrangement. For example, cutter blades 42 and punching members 76 could be mounted on reciprocating guillotine-like actuating apparatus.

According to some important aspects of the invention, the downstream breaker station 62 includes punch members aligned with the tab-like connector portions formed upstream. Further, the vacuum belt engages cut portions of the web, so as to be positioned laterally adjacent the punch members at the point in time when the tab connectors are broken and the upstream sheet portion is completely severed. Accordingly, other patterns and apparatus for partially severing connector members between adjacent sheet portions is contemplated by the present invention. For example, the partially-severed portions need not include the end portions 50 and the central portion 52, as illustrated in FIG. 5. Rather, the undercut rings of anvil roller 40 may be rearranged to provide a single tab-like connector at the center of the web 12 and at the outermost lateral edges of that web, with the vacuum belt aligned with the central portions of the web, rather than underlying the lateral edge portions as illustrated in the drawings.

As a further variation contemplated by the present invention, the web-engaging means providing control of the cut sheet portions need not rely on a vacuum engagement with web 12. The engaging means could, for example, comprise an endless flexible magnetic belt if the web material had sufficient ferrous content in its composition. Alternatively, the belt could employ static charges to attract and hold the web thereto. This latter arrangement could be utilized with extremely thin plastic films, too delicate or otherwise incompatible for use with a vacuum belt arrangement.

As an example of a practical application which immediately benefited from the present invention, the production rate of a high-speed wrapper assembly line for wrapping and packaging sticks of food products, such as butter, margarine, cheese products or the like was increased from 150 to approximately 700 wrappers per minute, with the web velocity increased from 175 feet per minute to approximately 300 feet per minute. The invention could also be used with other, non-food products. Web velocities in excess of 500 feet per minute are also made possible by the present invention. The web comprised a composite of foil and paper glued together, approximately 0.002 inches in thickness and 6 inches in width. The cut sheets formed were approximately 5 inches in length. The present invention is particularly advantageous when used to provide cut sheets ranging between one inch in width to virtually any desired width, and four inches in length to virtually any desired length. For this particular web material, annular or ring-like undercuts of approximately 0.02 inches wide and 0.015 inches deep were formed in the anvil 40. Operation was generally satisfactory up to a production rate of 500 wrappers per minute, although occasional premature breaking of the connecting portions was observed, particularly on starting and stopping of the assembly line. Thereafter, the undercut rings were enlarged to 0.045 inches in width, creating a connecting portion of approximately the same extent. Operation proved thoroughly satisfactory even at production rates approaching 700 wrappers per minute with any desired frequency of stopping and starting of the production line.

Preferably, the webs are formed so as to be relatively weak with respect to breaking forces perpendicular to the web plane, but still strong enough to withstand normal forces caused by a buildup of cohesive material on the cutting blades as well as forces applied in a shear or axial direction. In this manner, the final breaking of the connecting portions was accomplished relatively easily, with minimum disturbance to the adjacent sheet portions, but still is strong enough to break any adhesion with the cutting blades and to resist any premature tearing prior to processing of the connecting portions at breaker station 62.

It will thus be seen that the objects hereinbefore set forth may readily and efficiently be attained and, since certain changes may be made in the above construction and different embodiments of the invention without departing from the scope thereof. It is intended that all matter contained in the above description or shown in the accompanying drawings shall be interpreted as illustrative and not in a limiting sense.

What is claimed is:

1. An apparatus for processing a web having opposed edges spaced apart by a preselected width and defining a serial succession of sheet portions with intermediate portions therebetween, to provide a continuous succession of cut sheets downstream of said web, comprising:

a first work station downstream of said web;

web feeding means for feeding a first sheet portion downstream of said first work station to present to said first work station an intermediate portion interposed between said first sheet portion and an adjacent following sheet portion;

partial severing means at said first work station for severing said intermediate portion along a plurality of spaced-apart generally colinear line segments extending between the opposed edges of said web, said line segments including outer line segments extending toward each other from the opposed edges of said web and at least one medial line segment therebetween having end portions spaced from the outer line segments for forming at least a pair of spaced-apart tabs for interconnecting said first and following sheet portions, one tab intermediate each end of the at least one medial line segment and an outer line segment, each tab extending along the severing line;

a second station downstream of said first work station;

web transport means bridging the outer line segments for feeding said first sheet portion downstream of said second work station so as to present said tabs thereto; and breaking means at said second station for breaking said tabs along said severing line while engaging said first sheet with said web transport means, to thereby free said first sheet for independent movement with respect to said web, the breaking means including first and second opposed rollers for receiving said web therebetween, one said roller having at least one projecting portion for each tab, the projecting portions receivable in at least one mating recess of said other roller, said first and second rollers aligned so that said projections push said tabs into said recess to thereby break said tabs.

2. The apparatus of claim 1 wherein said web transport means comprises a continuous web-engaging belt extending from a point intermediate said first and said second stations to a point downstream of said second station.

3. The apparatus of claim 1 wherein said partial severing means comprises first and second opposed rollers for receiving the web therebetween, a cutting blade carried on one roller and dimensioned to extend between the edges of the web, and the other, opposed roller having an outer surface for supporting the web during cutting thereof by the blade and further having recesses formed in the outer surface thereof, so as to prevent cutting of that portion of the web lying between the cutting blade and the recesses during the cutting operation whereby tabs are formed along the severing line at locations corresponding to the recesses of the second, opposed roller.

* * * * *